US006866079B2

(12) United States Patent
Lee

(10) Patent No.: US 6,866,079 B2
(45) Date of Patent: Mar. 15, 2005

(54) DECORATIVE LIGHT BLOCKING ASSEMBLY FOR BLINDS

(76) Inventor: Han-Sen Lee, 98-1, Show-Tsuo St. Show-Tsuo Village, Fu-Hsing Hsiang, Chang-Hwa Hsien (TW)

( * ) Notice: Subject to any disclaimer, the term of this patent is extended or adjusted under 35 U.S.C. 154(b) by 25 days.

(21) Appl. No.: 10/440,288

(22) Filed: May 15, 2003

(65) Prior Publication Data

US 2004/0226664 A1 Nov. 18, 2004

(51) Int. Cl.[7] ..... E06B 9/38
(52) U.S. Cl. ..... 160/178.1 R; 160/172 R
(58) Field of Search ..... 160/178.1 R, 173 R, 160/89, 172 R, 178.3 R; 49/74.1; 139/384 A

(56) References Cited

U.S. PATENT DOCUMENTS 2,072,464 A * 3/1937 Nisenson ..... 160/176.1 R
2,130,320 A * 9/1938 Hammer ..... 160/178.3
2,152,117 A * 3/1939 Wade et al. ..... 160/177 R
2,251,363 A * 8/1941 McGrew ..... 160/168.1 R
2,457,442 A * 12/1948 Brent ..... 160/178.3
2,678,688 A * 5/1954 Dragon ..... 160/173 R
2,716,448 A * 8/1955 Landess ..... 160/173 R
2,914,122 A * 11/1959 Pinto ..... 160/89
2,994,370 A * 8/1961 Pinto ..... 160/89
5,490,553 A * 2/1996 Colson et al. ..... 160/84.06

* cited by examiner

*Primary Examiner*—David Purol
(74) *Attorney, Agent, or Firm*—Curtis L. Harrington

(57) ABSTRACT

A blind extension system with removable soft side blinders or light blocking structures provides an organizational system which can be used to reduce light due to improper sized blinds without damaging the blinds or the window frame itself. In one embodiment, a sock-like structure is used to attach lengths of decorative materials at the outer ends of horizontal blinds. The sock-like structures are provided periodically along the vertical length of a projecting soft, decorative material. A series of extension pins can be used to assist the horizontal extension of the soft decorative material sufficient to reach the sides of the window opening space. Alternative methods of attachment are shown including a first embodiment of a clip attachable with vertical movement onto the elongate edge of a louver, and a second embodiment of a clip which is attachable with horizontal movement directly onto the end edge of the louver.

5 Claims, 4 Drawing Sheets

DECORATIVE LIGHT BLOCKING ASSEMBLY FOR BLINDS

FIELD OF THE INVENTION

The present invention relates to a convenience structure for closing or occupying unwanted space between a window blind structure and a window frame, and more specifically a structure to provide users with a window shade system for bordering a window blind structure, to enhance the shading of light, to help save money, time, and to provide variety, and a more organized and decorative window shading system.

BACKGROUND OF THE INVENTION

In the past, there have been several different methods for supplementing previous blind structures which typically are arranged to have too small of a horizontal dimension such that light is admitted at the side edges. This problem has a range of physical shortcomings from a custom installation with minimum clearance between the ends of the horizontal blinds to a mis-fit installation where gross amounts of mis-fit creates from one to several inches of gap horizontally. In both cases there is unwanted peripheral light, especially along the vertical edges.

Horizontal length shortcomings may typically be handled by slat or louver additions, where possible, or by providing an additional vertical attachment to the bottom louver. In many cases, both vertical and horizontal gaps are attempted to be eliminated by methods consisting of major construction and/or mechanic installation, which can be costly. One of the methods consists of installing a peripheral partially enclosing window molding to encroach on all sides of the window frame. While this solution does solve the problem of having too much of an opening between the end of the window blinds and the window frame, it can be expensive and time consuming to install, and it may require some minor construction and or modification to the installation site where it is being installed.

Further, the window molding solution may use materials such as plastic or a material like wood, warping and rotting from cyclical exposure to the sunlight and moisture changes from the open window. As a result, these materials may have to be replaced often. When typical window moldings remain in a normal setting such as a house, the window moldings can be easily ruined by everyday occurrences such as water damage, thermal cracking, wood rot, bowing and fracturing, children's abuse of the molding, chipped paint, and termites. To replace the damaged window moldings with new ones, the user would have to destructively remove the damaged moldings, buy new moldings, have an installer install them or begin measuring and cutting them for a custom installation. This can be very costly and time consuming for the user.

Another need for blocking out light includes the case of a mis-match results from a blind installation where an oddly sized window makes it impossible for a buyer to purchase a standard size of blind without having space between the blind and the window frame. Many people have become so frustrated that the blinds do not appropriately fit the window that they have simply given up and erected any object, such as messily glueing aluminum foil to a window or putting up cloth as a cheap way to cover up the space. Both of these solutions look unprofessional and are at the most, quite temporary, not to mention that these seemingly simple solutions might be more costly in the long run from the sloppy nature of the installation.

Most window extensions used to block out extra light are usually made out of plastics, a material that while durable and unaffected by moisture, isn't the most flexible material, and if used near a window where it can be in direct sunlight, the plastic can warp, and if colored, will most likely fade. Rubber, like plastic, can also warp due to it's tendency to expand when heated, and if colored, will also fade with time.

For both the plastic and rubber material options, use would occur by applying the materials directly to the window surface. This solution would not enable easy selective admission and blockage of light without installation and un-installation. After direct application, if the user decided to remove the rubber or plastic sun blockers, a residue behind of adhesive would be left behind which would cause the expenditure of more money for removal.

The ability to inexpensively and simply block out light from improper sized blinds is conventionally not available, or is not available at a reasonable cost. What is therefore needed is a device or structure which can easily and affordably provide sun blocking in the gap between horizontal blinds and window openings. The device needs to be easy to use so it will be more convenient. It needs to be simple to use and easy to removed. Users will not have to do a lot of preparation, installation and clean up The device needs to be simple and inexpensive, so a majority of the general public can afford it. The device needs to help in reducing the time and effort spent in removing, changing, and installing side sun blocking structure.

SUMMARY OF THE INVENTION

A blind extension system with removable soft side blinders of the present invention provides an organizational system which can be used to reduce light due to improper sized blinds without damaging the blinds or the window frame itself. In one embodiment, a sock-like structure is used to attach lengths of decorative materials at the outer ends of horizontal blinds. The sock-like structures are provided periodically along the vertical length of a projecting soft, decorative material. A series of extension pins can be used to assist the horizontal extension of the soft decorative material sufficient to reach the sides of the window opening space.

Alternative methods of attachment are shown including a first embodiment of a clip attachable with vertical movement onto the elongate edge of a louver, and a second embodiment of a clip which is attachable with horizontal movement directly onto the end edge of the louver.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENTS

Figure 1:
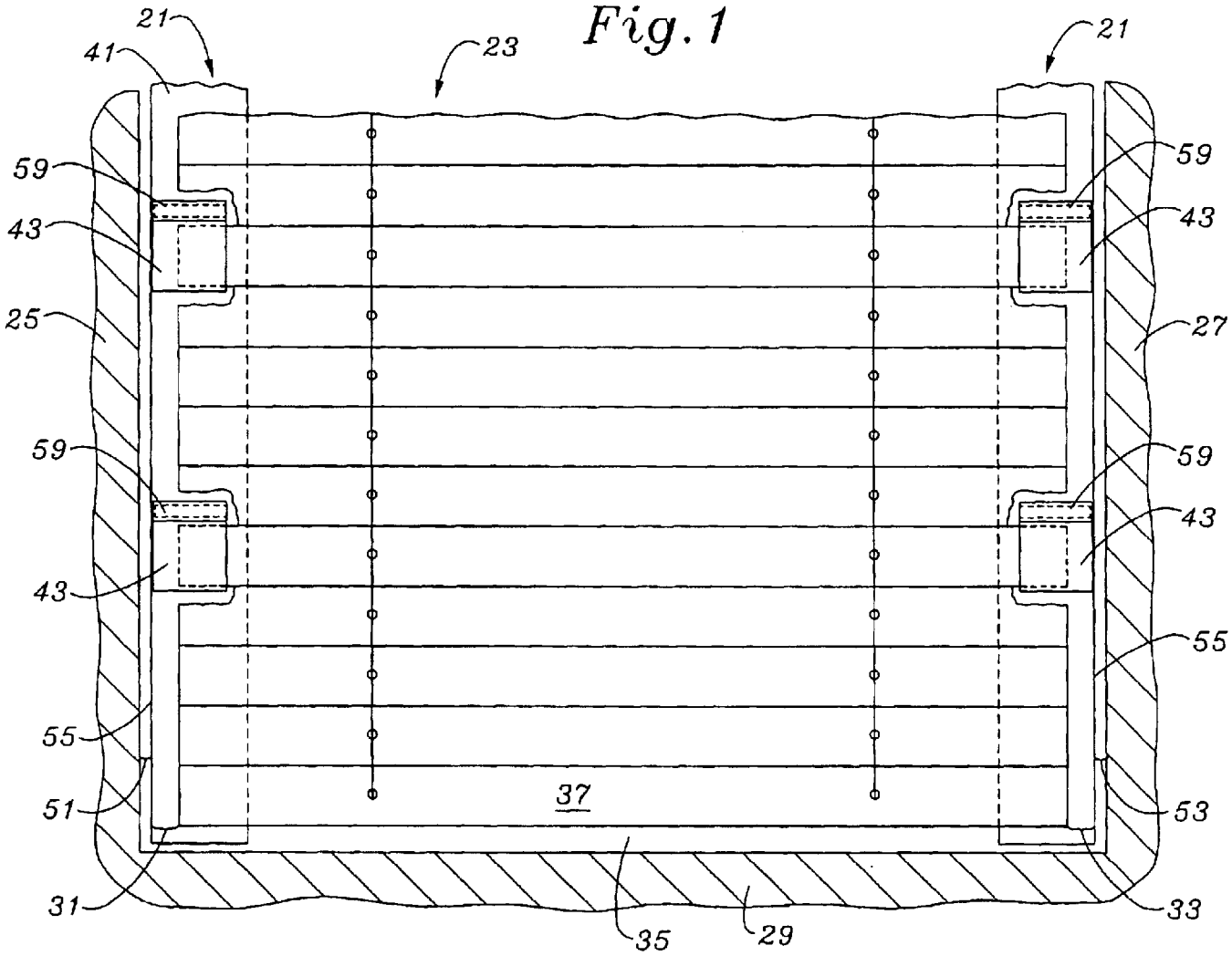
FIG. 1 is a plan, semi sectional view of a horizontal blind set within a window opening and having the decorative light blocking members attached with a sock-like structure.

A description of the inventive and decorative light blocking assembly 21 seen with respect to a horizontal blind set 23 shown within a window opening defined by vertical side walls 25 and 27 and a bottom wall 29. It is assumed that the top of the blind set 23 has appropriate top head rail and does not transmit light at its upper end. In some cases, horizontal blind sets 23 may be provided with several additional overlapping horizontal blind louvers to cover any gap between the head rail and the first horizontal louver.

As a result, the light gap predominantly results between the vertical blind set 23 and the vertical side walls 25 and 27. This is seen in FIG. 1 as a side gap 31 adjacent vertical side wall 25 and a side gap 33 adjacent vertical side wall 27. (A horizontal gap 35 is seen adjacent bottom wall 29, but this type of gap can be readily filled with a layer of cloth material affixed to the bottom wall 29, or by adding a width of material to a bottom one of a series of louvers 37.

Decorative light blocking assembly 21 has a vertical length of material 41, and a series of attachment structures, which in FIG. 1 are shown as a series of periodically occurring sock-like structures 43. The sock-like structures 43 are so named because one of the expected methods for engaging the ends of the louvers 37 is expected to be an elastic expansion similar to that seen in footwear.

The sock-like structures 43 may be made of elastic material which will open to admit the end of the louvers against an elastic closure force. The sock-like structures 43 may have a pair of open ends or may have one closed end and one open end. The use of one closed end may help in stabilization, but overall integrity will depend upon materials chosen and the holding forces involved. Where a 5 close-ended sock-like structure 43 is used, the open ends should be oriented to the same side of the vertical length of material 41.

The sock-like structures 43 are arranged in a same orientation along the length of the vertical length of material 41 and open to one side. It is expected that the decorative light blocking assembly 21 will be provided in two lengths, one as a right side length with the sock-like structures 43 having openings attached to hang down from the vertical length of material 41 so that the openings of is the sock-like structures 43 open to the left, and one as a left side length with the sock-like structures 43 having openings attached to hang down from the vertical length of material 41 so that the openings of the sock-like structures 43 open to the right.

Once the sock-like structures 43 are fitted onto the end of one of the louvers 37, the sock-like structures 43 it would be held in place by a combination of elastic closure force against the louver 37, as well as friction between the inside sock-like structures 43 and the louver 37. This dual mechanism for holding contemplates the possibility of selection of material for the sock-like structures 43 which has enhanced friction and elasticity, as well as the addition of materials to sock-like structures 43 to enhance elastic hold and frictional engagement, including stiffeners and added elastic.

As will be seen, the sock-like structures 43, preferably manage to engage the vertical length of material 41 so as to stabilize the pivot point between the sock-like structures 43 and the vertical length of material 41. In the normal movement of vertical blinds, a given louver 37 will move through an arc from a closed position where the top of the louver 37 is directed toward the inside of a room and where the lower edge sits atop the next most adjacent louver, to an arcing position through a nearly horizontal position, to a second closed position with the bottom the louver 37 being directed toward the inside of a room and where the lower edge sits atop the next most adjacent louver below it, to an arcing position through a nearly horizontal position, and then to a second closed position with the bottom of the louver 37 directed toward the inside of the room and with the same edge which was on the bottom in the first closed position now on top and adjacent the louver 37 above it.

The pivot point between the sock-like structures 43 and the vertical length of material 41 follows the location of this edge so that the vertical length of material 41 can follow inside of the room, cover the sock-like structures 43, and so that the vertical length of material 41 will have a close adjacency relationship with respect to the internally directed surfaces of the louvers 37 at both closed positions. At the middle, open position the vertical length of material 41 continues to cover the sock-like structures 43, although the sock-like structures 43 may be seen if the vertical length of material 41 is viewed at an angle from either above or below the louver 37. At the middle, open position the vertical length of material 41 only has close adjacency to the edge of the louvers 37 farthest from the window.

Thus the arrangement of providing pivoting about the edge of the louvers 37 closest to the center of a room in which the window opening is located and farthest from the window is such that the decorative light blocking assembly 21 will not bind the movement of the louvers 37 and will always be in a close, light blocking relationship with the louvers 37 when louvers 37 are brought to either of their closed positions.

The effectiveness of the decorative light blocking assembly 21 can be seen in FIG. 1 with reference to the side gaps 31 and 33 which represent the space between the ends of the horizontal louvers to the vertical side walls 25 and 27. The decorative light blocking assembly 21 can be seen to reduce the side gaps 31 and 33 to what is shown as a smaller gap 51 and 53, respectively. In reality, the smaller gaps 51 and 53 are shown as such for understanding, but will preferably be so small that they will be de minimis or zero. The actual showing and identification of a gap is to enable an outer edge 55 to be identified and discussed.

Preferably, the decorative light blocking assembly 21 will be made predominantly of soft cloth material, especially for the vertical length of material 41. The amount of material which extends beyond the ends of the louvers 37, and across the side gaps 31 and 33 has to be upheld from the periodically occurring sock-like structures 43. If the vertical length of material 41 is too flimsy, or if it is not well supported by the periodically occurring sock-like structures 43, it may droop or tend to fold in one direction or the other and leave an enlarged smaller gaps 51 and 53. Conversely, if the vertical length of material 41 is too rigid it may engage the vertical side walls 25 and 27 and create a vertically elongate slit type gap 51 and 53. The preferred material should urge the vertical length of material 41 into close, consistent, sweeping, light blocking proximity to the vertical side walls 25 and 27.

An option, and for optional use, the sock-like structures 43 may be fitted with a pocket for carrying a support member 59 to effectively extend a portion of the support ability garnered by the sock-like structures 43 across the width of the vertical length of material 41. The pocket carrying the support member 59 need not extend completely across to the outer edge 55, especially depending upon the material used for the material 41

Further, it is expected that the user will observe the width of the side gaps 31 and 33 to determine if the width is sufficient that support members 59 will be needed. Further to this judgement, it is noted that the periodically occurring sock-like structures 43 are shown as extending all the way over to the outer edge 55, but need not do so. In the configuration shown where they do extend all the way to the outer edge 55, the user has to back them off from a position where the periodically occurring sock-like structures 43 are completely fitted over the ends of the louvers 37 to which they are attached.

This "backing off" from full conforming fit is done so that the outer edge 55 can be moved toward the vertical side walls 25 and 27 to reduce the size of the side gaps 31 and 33 to minimize the smaller gaps 51 and 53, preferably to zero. Ideally the back off of the periodically occurring sock-like structures 43 will be equally shared on both sides of the horizontal blind set 23 so that one decorative light blocking assembly 21 will not be over-extended (at least not more than the other decorative light blocking assembly 21 on the other side.

Note also the term "periodically" in the phrase periodically occurring sock-like structures 43. Horizontal blind sets may be available in certain standardized width of louvers 37, having a standardized overlap and standard spacing. The decorative light blocking assembly 21, however may or may not have a completely matched set of periodically occurring sock-like structures 43. Where additional material of the vertical length of material 41 exists between two periodically occurring sock-like structures 43, the material is simply left to form a horizontal fold.

The end edges of the horizontal fold still simply abut the vertical side walls 25 and 27, and even provide some stress relief over what would otherwise be a potentially tightened length of the vertical length of material 41 which would not gently abut the vertical side walls 25 and 27. Further, since the sock-like structures 43 are periodically occurring, any resulting horizontal folds from extra material will also periodically occur, forming a gentle wide curved fold at the bottom of each expanse of material between the periodically occurring sock-like structures 43.

As shown in FIG. 1, the periodically occurring sock-like structures 43 are connected to every fifth louver 37. In practice, a periodically occurring sock-like structures 43 can be provided for each louver 37. In this event, the excess material would be even between each louver 37 and form a more regular decorative pattern. Alternatively, where the periodically occurring sock-like structures 43 is connected to every other louver 37, the periodicity of the excess material is still regular and controlled, but has a periodicity twice that of the vertical height position of each louver 37. Depending upon how the louvers 37 are set to rotate, the availability of excess material of the vertical length of material 41 might actually change depending upon the angular position of the louvers 37.

Moreover, the vertical length of material 41 is intended to be selected based upon its color, its light transmissive or blocking qualities, and a pattern which might preferably match or complement window and room decor. For example, the cloth material from which the vertical length of material 41 is constructed might match the curtains, a valance, or the furniture. The vertical length of material 41 could be chosen to admit some light or to create a pattern upon application of rear lighting. Further, the type of cloth material from which the vertical length of material 41 is made could vary widely, including all cloth, paper, plastic and other types of material. Rayon or nylon may be preferred in some cases due to the silence which would result from movement of the horizontal blind set 23 and thus movement of the outer edge 55 of the vertical length of material 41 against the vertical side walls 25 and 27.

Figure 2:
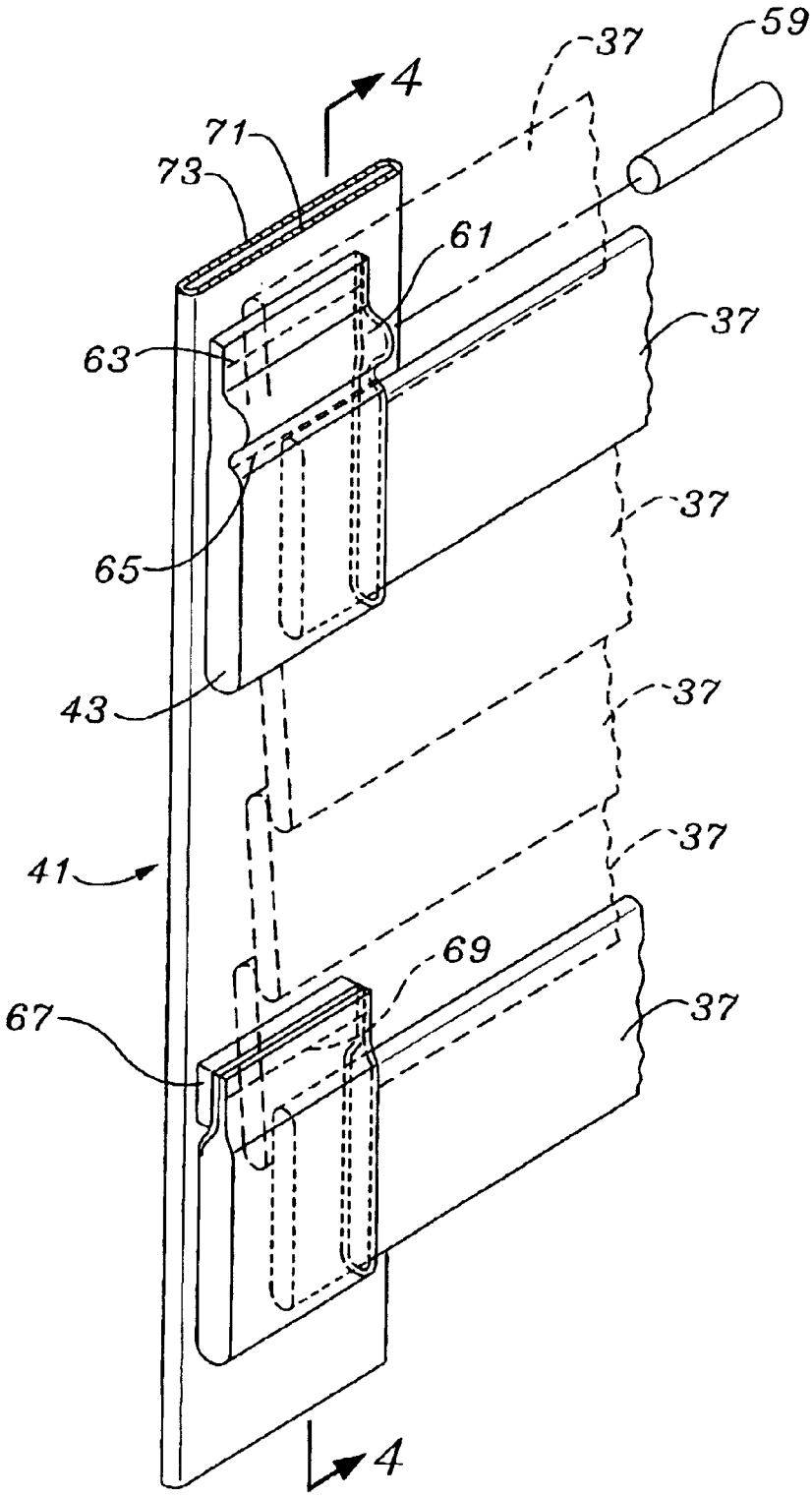
FIG. 2 is a perspective view illustrating the sock-like attachment of one vertical length of soft decorative material, along with the optional use of a force extension pin.

FIG. 2 illustrates a rear view to illustrate the attachment of the periodically occurring sock-like structures 43 to individual louvers 37. Because of the louver 37 overlap, each overlapping louver 37 has to be broken away in order to see the details of the periodically occurring sock-like structures 43 with respect to the vertical length of material 41. Further, many of the structures seen in FIG. 2 are much larger than they would actually be in an actual embodiment, and where overlap of the louvers 37 sandwiching any of the structures adjacent the sock-like structures 43 is had, there will be little or not separation created between louvers 37.

Referring to the top of FIG. 2, one way to extend support from the louvers 37 is had by creating a pocket 61 to one side of the periodically occurring sock-like structures 43 by providing a first stitch 63 spaced apart from a second stitch 65, with the support member 59 snugly held by the pocket 61 formed between the two stitches.

By forming the pocket 61 more closely adjacent the louver 37, the position of the support member 59 is stabilized along its projection away from the louver 37. The pocket could be added beneath the louver 37, or on sock-like structure 43 at a broad surface of the louver 37. It is because the stiffness or support ability of the sock-like structure 43 ends at the end of the louver 37 that the support member 59 may be optionally needed. In the alternative, the sock-like structure 43 could be made of a more laterally supportive material. However, support member 59 enables the user to introduce, control or eliminate the projected support from the louver 37.

The bottom of FIG. 2 illustrates the use of a stiffening member 67 sewn between the sock-like structure 43 and the vertical length of material 41. A single stitch 69 is sewn straight through an area of the joined ends of the sock-like structure 43 and at least one layer of the vertical length of material 41. The upper end of vertical length of material 41 as seen in FIG. 2 illustrates it as being two layers, generally doubled over in order to enable a rear layer 71 to accept stitching and to be covered over by a facing or front layer 73 to enable an untrammeled decorative appearance facing into the room. The double layering of the vertical length of material 41 can be by finished stitching, gluing or any other technique.

Figure 3:
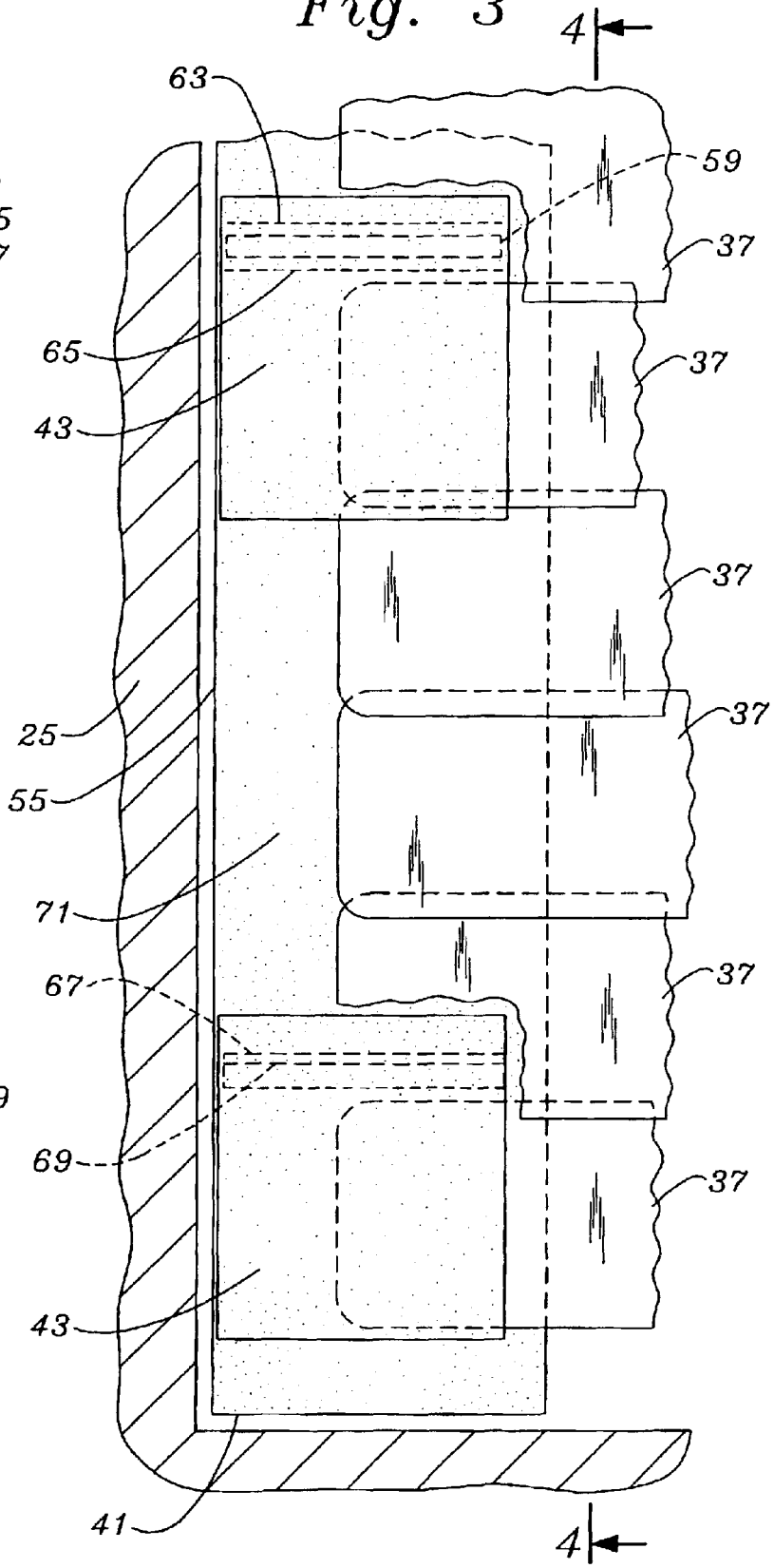
FIG. 3 is a closeup view, similar to that seen for FIG. 1 and illustrating further details of the vertical decorative light blocking structure.

Referring to FIG. 3, a plan view corresponding to the perspective view of FIG. 2 is seen. At the top of FIG. 3, the support through the support member 59 is seen as extending support to the outer edge 55 by virtue of underlying support of the top of the louver 37. Again, the support member 59 could be backed off from its position all the way into the pocket 61 to produce more flexibility at the outer edge 55. At the lower end of FIG. 3 is seen the plastic insert which is sewn directly with the stitch 69 and which transmits support toward the outer edge 55. However, as can be seen, the plastic insert 67 stops about one quarter to one eighth of an inch short of the outer edge 55, in this case in order to provide increased flexibility but only at an abbreviated end width of the vertical length of material 41.

Figure 4:
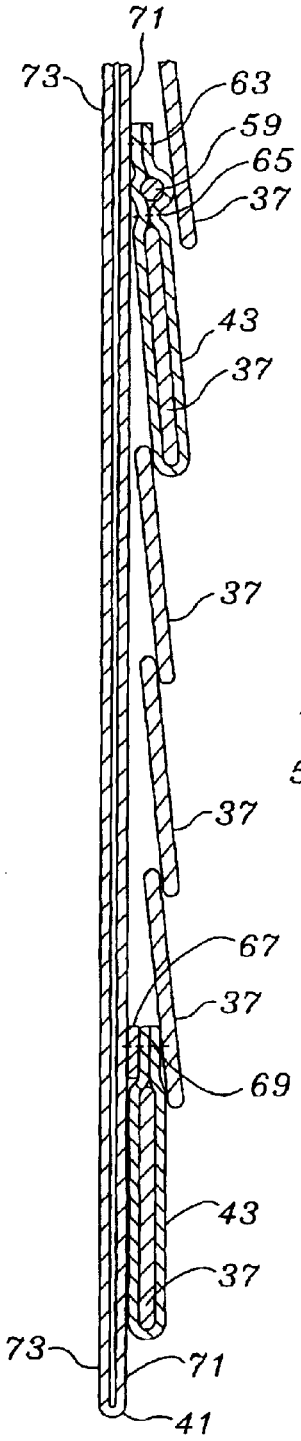
FIG. 4 is a side sectional view taken along line 4—4 of FIG. 3.

Referring to FIG. 4, a side view corresponding to the plan view of FIG. 3 is seen and illustrates further details of the foregoing description. Again, the periodically occurring sock-like structures 43 can be more numerous or less numerous covering every louver 37 or every other louver 37 or every third louver 37, or every fourth louver 37, or as is shown, every fifth louver 37. A clearer view of the strip of plastic 67 is seen as creating a very low side profile. Both methods shown in FIGS. 2-4 enable advantageous pivoting of the vertical length of material 41 through the periodically occurring sock-like structures 43.

Figure 5:
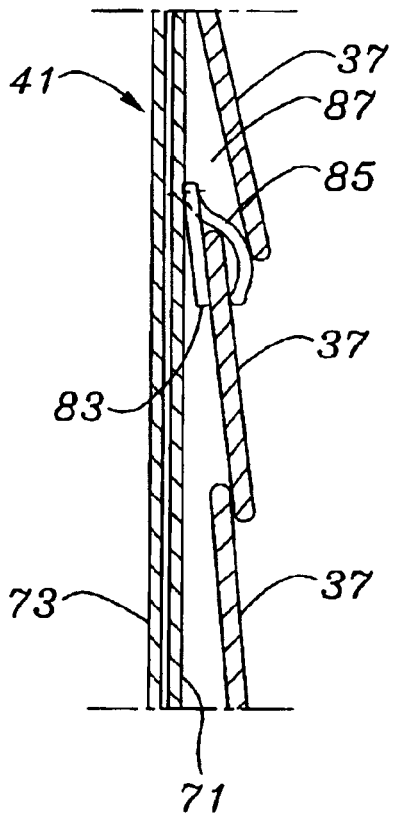
FIG. 5 is a side sectional view of a further embodiment seen as a clip installed by vertical movement onto the top or bottom of a louver.

Referring to FIG. 5, an alternate attachment and pivoting structure is shown from the same side viewpoint as FIG. 4, but which uses a vertical path of attachment clip 81 which attaches directly to the top of the louvers 37. The clip is preferably of resilient plastic and has a base member 83 and an upper member 85 opposing the base member 83 and forming a pinching structure for pinching engagement of one upper (or lower) main, longer or elongate edge of the louver 37.

As is also shown, a stitch 87 has been used to sew the attachment clip 81 directly to the rear layer 71. The attachment clip 81 has a thin profile and provides pivoting again very near the elongate edge of the louver 37.

Figure 6:
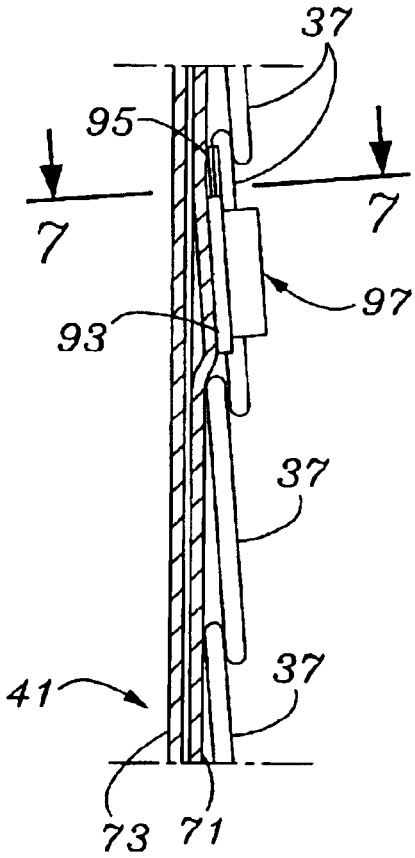
FIG. 6 is a side view of a further embodiment and illustrating a rear view of a clip installed by horizontal movement onto the end of a horizontal louver.

Referring to FIG. 6, a further embodiment of an attachment clip is seen as an end clip 91. End clip 91 attaches to the end surface of the louver 37 and has both a thin profile and a narrow profile. The thin profile brings the vertical length of material 41 closer to the louvers 37. The narrow profile insures that the width of the end of the louver 37 occupied will be so abbreviated that there will be no interference with the louver to louver contact on closure.

This is illustrated in FIG. 6 where the louver 37 to louver 37 contact on closure is seen. The clip 91 has an under-louver base 93 which is preferably sewn with a stitch 95 near an edge of the louver 37. From the under-louver base 93, an opposing member 97 opposes the under-louver base 93 to form a louver 37 engaging clip structure. Thus the advantages of a near louver 37 edge pivot is seen, but with the added advantages of end attachment, no elongate edge interference in one closure direction, and a thin profile.

Figure 7:
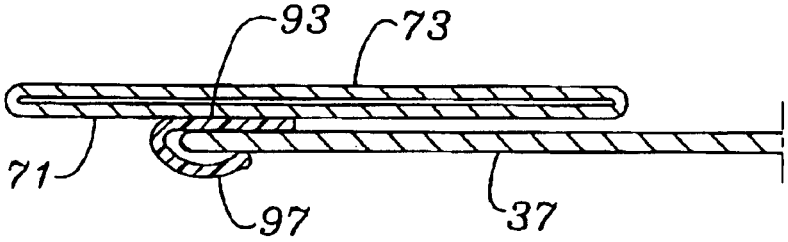
FIG. 7 is a sectional view taken along line 7—7 of FIG. 6.

Referring to FIG. 7, a top view illustrates a section taken through the upwardly extending (with respect to FIG. 6) portion which is stitched with stitch 95 to the rear layer 71. The stitch 95 may occur just across from or even beyond the upper (as shown in FIG. 6) elongate edge of the louver 37.

The invention has been described in terms of a user selectable and install-able horizontal blind side edge addition. However, the materials, configuration and technique of the present invention may be applied to any movable structure for which blocking extension is desired and especially a decorative extension having the ability to provide and extension of structural support. It especially relates to any structure which enables structural support to be extended based upon user preference as well as upon selection of materials and addition of user adjustable structural support extensions.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A decorative light blocking assembly for fitting onto the ends of a horizontal blind set having louvers to cover a gap created between the horizontal blind set and the opening into which it is placed and comprising:

a vertical length of material having a first side and a second side, and a first width for use in covering said gap created between the horizontal blind set and the opening into which it is placed; and a plurality of sock-like structures having a first open end and a second closed end, and periodically attached evenly along said second side of said vertical length of material, each first open end of said sock-like structure opening toward an elongate edge of said vertical length of material for engaging completely around at least a plurality of said ends of said horizontal blind set.

2. The decorative light blocking assembly recited in claim 1 wherein said plurality of sock-like structures are attached to said vertical length of material by sewing and wherein said plurality of sock-like structures pivot with respect to said vertical length of material at said stitching.

3. The decorative light blocking assembly recited in claim 1 wherein said vertical length of material includes a rear layer attached to said plurality of sock-like structures, and a front layer attached to said rear layer.

4. The decorative light blocking assembly recited in claim 1 and further comprising a horizontal blind set having a plurality of louvers engaged by said plurality of sock-like structures, said vertical length of material extending the horizontal light blocking ability of said horizontal blind set.

5. The decorative light blocking assembly recited in claim 4 wherein said decorative light blocking assembly is a first decorative light blocking assembly engaging a first side of said horizontal blind set and further comprising a second decorative light blocking assembly engaging a second side of said horizontal blind set opposite said first side of said horizontal blind set.

* * * * *